US012083580B2

(12) United States Patent
Wang et al.

(10) Patent No.: US 12,083,580 B2
(45) Date of Patent: Sep. 10, 2024

(54) METHOD FOR FORGING NIOBIUM-TUNGSTEN ALLOY FORGED RING

(71) Applicant: Xi'an Space Engine Company Limited, Xi'an (CN)

(72) Inventors: Kai Wang, Xi'an (CN); Youqiang Liu, Xi'an (CN); Peng Zhang, Xi'an (CN); Jinwu Miao, Xi'an (CN); Zhimin Chen, Xi'an (CN); Yang Xie, Xi'an (CN); Xiaoming Wu, Xi'an (CN)

(73) Assignee: Xi'an Space Engine Company Limited, Xi'an (CN)

( * ) Notice: Subject to any disclaimer, the term of this patent is extended or adjusted under 35 U.S.C. 154(b) by 511 days.

(21) Appl. No.: 17/558,882

(22) Filed: Dec. 22, 2021

(65) Prior Publication Data

US 2022/0126355 A1 Apr. 28, 2022

(30) Foreign Application Priority Data

Mar. 31, 2021 (CN) ..... 202110350489.5

(51) Int. Cl.

| | |
|---|---|
| ***B21H 1/06*** | (2006.01) |
| ***B21J 1/04*** | (2006.01) |
| ***B21J 5/02*** | (2006.01) |
| ***C21D 8/02*** | (2006.01) |
| ***C22F 1/18*** | (2006.01) |
| *C21D 9/40* | (2006.01) |

(52) U.S. Cl.

CPC ..... *B21H 1/06* (2013.01); *B21J 1/04* (2013.01); *B21J 5/02* (2013.01); *C21D 8/0273* (2013.01); *C22F 1/18* (2013.01); *C21D 9/40* (2013.01)

(58) Field of Classification Search

CPC ..... B21H 1/06; B21J 1/04; B21J 1/06; B21J 5/02; B21J 5/08; B21J 5/10; C21D 8/0273; C21D 9/40; C22F 1/18; B21K 1/761; B23P 15/00

See application file for complete search history.

(56) References Cited

FOREIGN PATENT DOCUMENTS

| | | | | |
|---|---|---|---|---|
| CN | 103147018 A | | 6/2013 | |
| CN | 104139141 A | | 11/2014 | |
| CN | 110977340 A | * | 4/2020 | ..... B23P 15/00 |

OTHER PUBLICATIONS

English translation of CN 110977340 obtained from espacenet.com (Year: 2020).*

* cited by examiner

*Primary Examiner* — Moshe Wilensky

(57) ABSTRACT

A method for forging a niobium-tungsten alloy forged ring, including: (S1) subjecting an alloy ingot to turning, chamfering, spraying with an anti-oxidation coating, stainless-steel sheathing, heating and upsetting to obtain a primary pancake with a flat-die hammer, rapid-forging press or hydraulic press; (S2) subjecting an inner pole to wire electrical discharge machining to obtain a ring blank followed by machining to remove the stainless-steel sheath and oxide scale and defects; and subjecting the ring blank to fluorescent/dye penetrant inspection followed by vacuum stress-relief annealing; (S3) subjecting the ring blank to core shaft/saddle forging on the flat-die hammer or rapid-forging press to obtain a crude forged ring; and (S4) subjecting the crude forged ring to vacuum recrystallization annealing to obtain a desired forged ring.

12 Claims, 1 Drawing Sheet

METHOD FOR FORGING NIOBIUM-TUNGSTEN ALLOY FORGED RING

CROSS-REFERENCE TO RELATED APPLICATIONS

This application claims the benefit of priority from Chinese Patent Application No. 202110350489.5, filed on Mar. 31, 2021. The content of the aforementioned application, including any intervening amendments thereto, is incorporated herein by reference in its entirety.

TECHNICAL FIELD

This application relates to refractory metal forging, and more particularity to a method for forging a niobium-tungsten alloy forged ring.

BACKGROUND

Due to the limitation of structure and weight, the upper-stage rocket engine, attitude and orbit control engine and space rocket engine generally use a single-walled radiation-cooled nozzle, of which the service temperature reaches 1200° C. or higher. The niobium-tungsten alloy has a high melting point and excellent mechanical properties at 1200-1800° C., and thus is considered as an ideal material for making the radiation-cooled nozzle of a rocket engine. Moreover, considering that a large change occurs in the wall thickness, cross section and curvature, and the welding seam is not allowed, the convergent-divergent section of a thrust chamber nozzle of the rocket engine is usually formed by machining a niobium-tungsten alloy forging blank.

Unfortunately, the forging forming of the niobium-tungsten alloy is greatly limited by high cost, poor high-temperature plasticity and pourability, high forging temperature, narrow forging temperature range and large forging deformation resistance. Currently, the manufacturing of the niobium-tungsten alloy forged part still suffers the following problems. (1) The niobium-tungsten alloy is easy to crack during the stretching process, such that it fails to enhance the deformation of a blank by repeated upsetting and stretching, failing to enable the desired material performance when machining a forged part with a diameter equal to or larger than 350 mm. (2) Due to the limitations of specification and size of an ingot, a body of the forged part with a diameter equal to or larger than 350 mm cannot be directly produced from a forged bar or forged disk. (3) The traditional machining of a thrust chamber body from the forged bar or disk has low material utilization rate and high cost.

SUMMARY

In view of the defects in the prior art that the machining of a niobium-tungsten alloy forged part has low material utilization rate, high cost, small forging deformation, unsatisfactory performance, and it is difficult to forge a forged ring with a diameter greater than 350 mm, the present disclosure provides a method for forging a niobium-tungsten alloy forged ring, where a tensile strength of the niobium-tungsten alloy forged part made by the method can reach 400 MPa at room temperature, 140 MPa at 1400° C. and 90 MPa at 1600° C., which can satisfy the machining need of the niobium-tungsten alloy body. In addition, the method provided herein can be also used for forging other refractory metal forged rings, such as molybdenum-zirconium-titanium alloy forged ring and niobium-hafnium alloy forged ring.

Technical solutions of the present disclosure are described as follows.

This application provides a method for forging a niobium-tungsten alloy forged ring, comprising:

(S1) subjecting a niobium-tungsten alloy ingot to blanking, turning and chamfering to obtain a primary blank; spraying an anti-oxidation coating on a surface of the primary blank to obtain a secondary blank; sheathing the secondary blank with a stainless-steel sheath followed by heating to obtain a tertiary blank; and subjecting the tertiary blank to upsetting to obtain a primary pancake by using a flat die hammer, rapid forging press or hydraulic press;

(S2) machining the primary pancake to remove the stainless-steel sheath and an oxide scale and defect on a surface of the primary pancake; subjecting the surface of the primary pancake to fluorescent penetrant inspection/dye penetrant inspection; when the surface of the primary pancake is free of defects, subjecting the primary pancake to vacuum stress-relief annealing to obtain a secondary pancake; and subjecting the secondary pancake to wire electrical discharge machining (WEDM) to form an inner hole to obtain a ring blank;

(S3) subjecting the ring blank to core shaft/saddle forging on the flat die hammer or rapid forging press to obtain a crude forged ring; and (S4) subjecting the crude forged ring to vacuum recrystallization annealing to obtain a desired forged ring.

In some embodiments, in the step (S1), after blanked, the niobium-tungsten alloy ingot is sequentially subjected to turning and chamfering at two end surfaces to obtain the primary blank; the stainless-steel sheath is manufactured from a stainless-steel plate; and the stainless-steel sheath is welded at an outer circumference and an end surface of the secondary blank by an argon arc welding technology.

In some embodiments, in step (S1), the heating is performed through steps of:

loading the secondary blank in a furnace at a temperature not higher than 850° C. followed by preheating at 850-950° C. for 1 h and heating to 1290±40° C.;

subjecting the secondary blank to heating at 1290±40° C. at a heating coefficient of 0.8 mm/min to obtain the tertiary blank; and subjecting the tertiary blank to air cooling;

wherein a final forging temperature is not less than 1000° C.

In some embodiments, when it is required to perform multiple heating operations to form the tertiary blank, the secondary blank is returned to the furnace with a temperature higher than 800° C. and subjected to heating at a heating coefficient of 0.5 mm/min.

In some embodiments, in step (S1), during the heating process, after heated for a preset period of time, the secondary blank is removed, subjected to soft sheathing with an aluminosilicate fiber with a thickness of 5-12 mm and a binding agent, then returned to the furnace and subjected to heating for 60-120 min to form the tertiary blank.

In some embodiments, in step (S1), a single-fire upsetting deformation of the niobium-tungsten alloy ingot is 0.1-0.35; and a height of the primary pancake obtained after the upsetting is 105-120% of a height of the desired forged ring.

In some embodiments, the step (S2) further comprises:

subjecting inner and outer circular end faces of the ring blank to rounding.

In some embodiments, polishing a surface of the ring blank to eliminate cracks, folds and pits thereon; and subjecting the ring blank after being polished to fluorescent penetrant inspection/dye penetrant inspection to further determine whether there are cracks, folds and pits on the surface of the ring blank;

wherein a width-depth ratio of a polished part on the ring blank is not less than 6:1.

In some embodiments, in step (S2), the vacuum stress-relief annealing is performed at 1250-1350° C. for at least 60 min.

In some embodiments, the step (S3) further comprises:

loading the ring blank at a temperature not higher than 850° C. followed by preheating at 850-950° C. for 1 h and heating to 1290±40° C.;

subjecting the ring blank to heating at 1290±40° C. at a heating coefficient of 0.8 mm/min; and subjecting the ring blank to air cooling;

wherein a final forging temperature is not less than 1000° C.; and after heated for a preset period of time, the ring blank is removed, subjected to soft sheathing with an aluminosilicate fiber with a thickness of 5-12 mm and a binding agent, then returned to the furnace and subjected to heating for 60-120 min.

In some embodiments, in step (S3), a core shaft is placed into the inner hole of the ring blank processed through WEDM; and the inner hole of the ring blank is subjected to expansion on a saddle.

In some embodiments, in step (S4), the vacuum recrystallization annealing is performed at 1350-1450° C. for at least 60 min.

Compared to the prior art, this application has the following beneficial effects.

(1) In the method provided herein, the forging formation of the niobium-tungsten alloy blank is performed at 1290±40° C., which reduces the deformation resistance of the niobium-tungsten alloy and also enhances the plasticity and pourability.

(2) On one hand, the single-fire upsetting deformation of the niobium-tungsten alloy is controlled to prevent the cracking. On the other hand, before the upsetting and saddle forming, edges of the primary pancake and edges of the ring blank are chamfered to prevent cracking caused by stress concentration on edges and too rapid cooling during forging.

(3) Before forging, the niobium-tungsten alloy is sprayed the coating, sheathed the stainless-steel sheath and subjected to soft sheathing with the aluminosilicate fiber, such that an oxidation of the tertiary blank during heating and forging is decreased, a rate of temperature reduction of a surface of the tertiary blank is decreased, and the surface is prevented from cracking caused by stress concentration on edges and too rapid cooling during forging.

(4) Before the saddle forming, the ring blank is subjected to fluorescent penetrant inspection/dye penetrant inspection to further determine whether there are cracks. The primary pancake is subjected to vacuum stress-relief annealing to eliminate stress during upsetting. A principle of the upsetting during forming the forged ring and a note of the saddle forging are provided, so as to avoid a lack of height of the primary blank, and a product scrapping caused by flatting the end surface of the ring blank untimely during saddle forming.

(5) This disclosure machines a core shaft to form the inner hole through WEDM, such that a residue can still be used for processing other parts, which improves the material utilization.

(6) Different from the traditional forging rod or disk, the disclosure employs a core shaft for hole-expansion, which enhances the total forging deformation and facilitates improving the material performance. The forged ring machined by the method provided herein can satisfy the processing requirements of the body of a niobium-tungsten alloy thrust chamber with a diameter of larger than 350 mm and a height of greater than 150 mm.

DETAILED DESCRIPTION OF EMBODIMENTS

Figure 1:
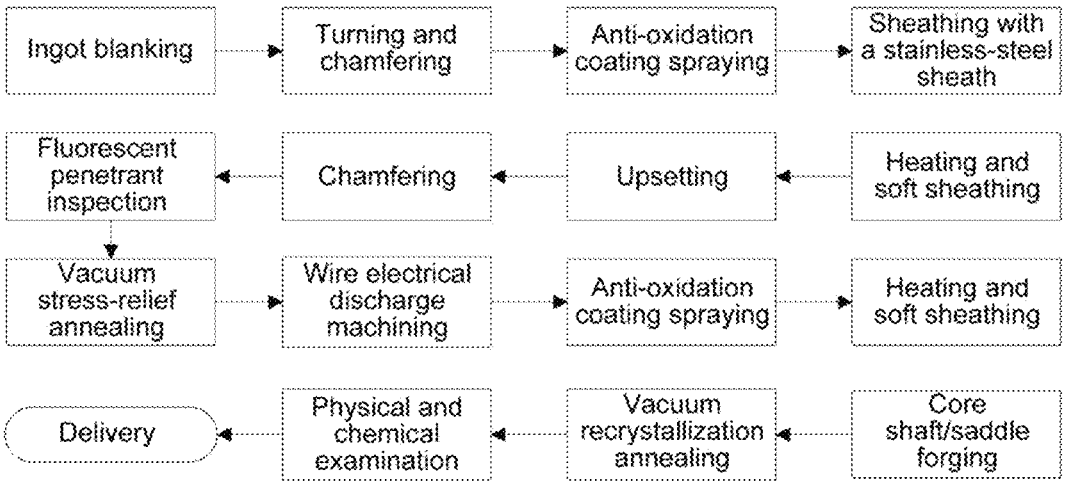
FIG. 1 is a flow chart of a method for forging a niobium-tungsten alloy forged ring according to Embodiment 1 of the present disclosure.

The disclosure will be clearly described below with reference to the embodiments.

This application provides a method for forging a niobium-tungsten alloy forged ring, which includes the following steps.

(S1) A niobium-tungsten alloy ingot is subjected to blanking, turning and chamfering to obtain a primary blank. A surface of the primary blank is sprayed by an anti-oxidation coating to obtain a secondary blank. The secondary blank is sheathed with a stainless-steel sheath followed by heating to obtain a tertiary blank. The tertiary blank is subjected to upsetting to obtain a primary pancake by using a flat die hammer, rapid forging press or hydraulic press.

(S2) The primary pancake is machined to remove the stainless-steel sheath and an oxide scale and defect on a surface of the primary pancake. The surface of the primary pancake is subjected to fluorescent penetrant inspection/dye penetrant inspection. When the surface of the primary pancake is free of defects, the primary pancake is subjected to vacuum stress-relief annealing to obtain a secondary pancake. The secondary pancake is subjected to wire electrical discharge machining (WEDM) to form an inner hole to obtain a ring blank.

(S3) The ring blank is subjected to core shaft/saddle forging on the flat die hammer or rapid forging press to obtain a crude forged ring.

(S4) The crude forged ring is subjected to recrystallization annealing in vacuum to obtain a forged ring.

In step (S1), after blanked, the niobium-tungsten alloy ingot is sequentially subjected to turning and chamfering at two end surfaces to obtain the primary blank; the stainless-steel sheath is manufactured from a stainless-steel plate; and the stainless-steel sheath is welded at an outer circumference and an end surface of the secondary blank by an argon arc welding technology.

In step (S1), the heating is performed through the following steps. The secondary blank is loaded in a furnace at a temperature not higher than 850° C. followed by preheating at 850-950° C. for 1 h and heating to 1290±40° C. The secondary blank is subjected to heating at 1290±40° C. at a heating coefficient of 0.8 mm/min to obtain the tertiary blank. The tertiary blank is subjected to air cooling, where a final forging temperature is not less than 1000° C.

When it is required to perform multiple heating operations to form the tertiary blank, the secondary blank is returned to the furnace with a temperature higher than 800° C. and subjected to heating at a heating coefficient of 0.5 mm/min.

In step (S1), during the heating process, after heated for a preset period of time, the secondary blank is removed, subjected to soft sheathing with an aluminosilicate fiber with a thickness of 5-12 mm and a binding agent, then returned to the furnace and subjected to heating for 60-120 min to form the tertiary blank.

In step (S1), a single-fire upsetting deformation of the niobium-tungsten alloy ingot is 0.1-0.35; and a height of the primary pancake obtained after the upsetting is 105-120% of a height of the desired forged ring.

In the step (S2), inner and outer circular end faces of the ring blank are subjected to rounding.

A surface of the ring blank is polished to eliminate cracks, folds and pits thereon. The ring blank after being polished is subjected to fluorescent penetrant inspection/dye penetrant inspection to further determine whether there are cracks, folds and pits on the surface of the ring blank, where a width-depth ratio of a polished part on the ring blank is not less than 6:1.

In step (S2), the vacuum stress-relief annealing is performed at 1250-1350° C. for at least 60 min.

The ring blank is loaded at a temperature not higher than 850° C. followed by preheating at 850-950° C. for 1 h and heating to 1290±40° C. The ring blank is subjected to heating at 1290±40° C. with a heating coefficient of 0.8 mm/min. The ring blank is subjected to air cooling, where a final forging temperature is not less than 1000° C.

After heated for a preset period of time, the ring blank is removed, subjected to soft sheathing with an aluminosilicate fiber with a thickness of 5-12 mm and a binding agent, returned to the furnace and then subjected to heating for 60-120 min.

In step (S3), a core shaft is placed into an inner hole of the ring blank processed through WEDM. The inner hole of the ring blank is subjected to expansion on a saddle. During the saddle forging process, two end surfaces of the primary blank are flatten timely to prevent upfolding.

In step (S4), the vacuum recrystallization annealing is performed at 1350-1450° C. for at least 60 min. Specifically, a part of the forged ring is cut as a sample. A metallographic structure, mechanical property at room temperature and mechanical property at high temperature of the sample are examined.

Figure 2:
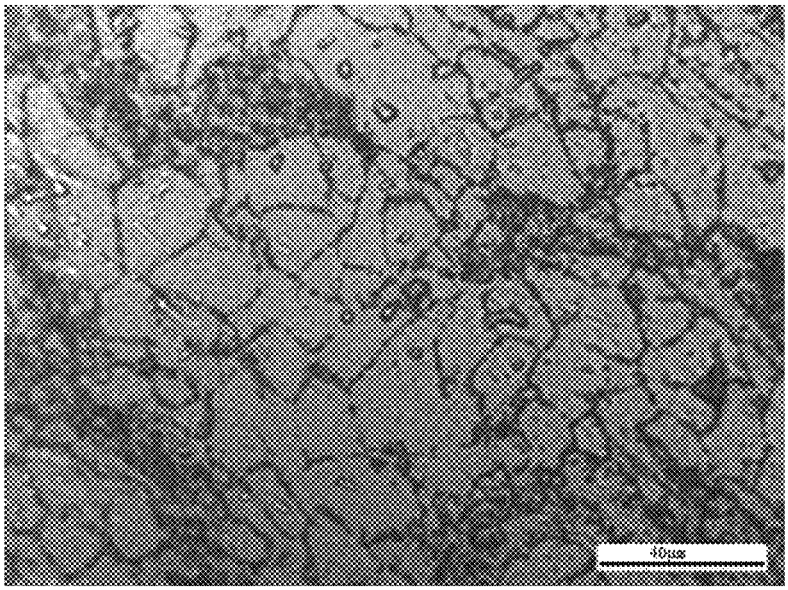
FIG. 2 depicts a metallographic structure of a forged ring after recrystallization annealing according to Embodiment 1 of the present disclosure.

The present disclosure provides a method for forging a niobium-tungsten alloy forged ring. Implementation will be clearly described below with reference to the accompanying drawings and embodiments. Specific content of heating temperature, heat preservation coefficient, etc. are described at summary, which will not go into details here. A size of the forged ring of embodiments is: an outer diameter of Φ440 mm, an inner diameter of Φ240 mm, a height of 225 mm. A flow chart is shown in FIG. 1, and a diagram of forming process is shown in FIG. 2.

Embodiment 1

(S1) A niobium-tungsten alloy ingot is subjected to blanking, turning and chamfering to obtain a primary blank according to a sized of Φ280 mm×560 mm. An anti-oxidation coating is sprayed on a surface of the primary blank to obtain a secondary blank. A stainless-steel sheath with a thickness of 2 mm is welded at an outer circumference and an end surface of the secondary blank by the argon arc welding technology to obtain a tertiary blank.

(S2) The tertiary blank is heated and subjected to soft sheathing followed by subjecting to blooming forging. In a first upsetting, the tertiary blank is treated by upsetting to a size of 450±5 mm. In a second upsetting, the tertiary blank is treated by upsetting to a size of 365±5 mm. In a third upsetting, the tertiary blank is treated by upsetting to a size of 300±5 mm. In a fourth upsetting, the tertiary blank is treated by upsetting to a size of 263±5 mm to obtain a primary pancake. In the first upsetting, second upsetting and third upsetting processes, the tertiary blank is allowed to subject to rounding and straightening. The primary pancake is subjected to air cooling after upsetting.

(S3) A secondary pancake after upsetting is subjected to WEDM to form an inner hole to obtain a ring blank. The ring blank is machined to remove the stainless-steel sheath and an oxide scale and defect on a surface of the ring blank. A size of the inner hole of the ring blank is Φ145 mm. An edge of the inner hole of the ring blank has a chamfer of R20. An edge of the out circle of the ring blank has a chamfer of R10. A height of the ring blank after turning is 255 mm.

(S4) The ring blank machined is subjected to fluorescent penetrant inspection/dye penetrant inspection. When a surface of free of defects, the ring blank is subjected to heating for 2 h and stress-relief annealing.

(S5) The ring blank is sprayed an anti-oxidation coating on a surface of the ring blank. An inner hole of the ring blank is subjected to expansion on a core shaft according to the above-mentioned requirements. The ring blank is subjected to 3-4-fire forming to obtain a crude forged ring. During the saddle forging process, two end surfaces of the crude forged ring are flattened timely to prevent the occurrence of recesses.

(S6) The crude forged ring is subjected to heating at 1350-1450° C. for 2 h and recrystallizing annealing. A forged ring after recrystallizing annealing is cut along a chord direction of the forged ring to obtain a sample. A metallographic structure, hardness, mechanical properties respectively at room temperature, 1400° C. and 1600° C. of the sample are tested. The metallographic structure is shown in FIG. 2 and the mechanical property is shown in FIG. 1, which demonstrates that the forged ring produced herein can satisfy a design requirement of the thrust chamber body at chamber pressure. The mechanical property at room temperature and mechanical property at 1600° C. according to Embodiment 1 satisfies the requirements of the standard "GJB8057 Specification for Niobium-Tungsten Alloy Rods for Aerospace"

TABLE 1

Mechanical properties of a niobium-tungsten alloy forged ring according to Embodiment 1

| Detecting temperature ° C. | Tensile strength Rm (MPa) | Yield strength Rp0.2 (MPa) | Elongation A (%) | Hardness HBW |
|---|---|---|---|---|
| Room | 429 | 340 | 29.0 | 152 |
| temperature | 426 | 337 | 30.8 | 150 |
| 1400° C. | 177 | 158 | 22.0 | / |
| | 158 | 154 | 22.0 | / |
| 1600° C. | 115 | 106 | 25.5 | / |
| | 129 | 125 | 26.0 | / |

(1) In the method provided herein, the forging formation of the niobium-tungsten alloy blank is performed at 1290±40° C., which reduces the deformation resistance of the niobium-tungsten alloy and also enhances the plasticity and pourability.

(2) On one hand, the single-fire upsetting deformation of the niobium-tungsten alloy is controlled to prevent the cracking. On the other hand, before the upsetting and core shaft forming, edges of the primary pancake and edges of the ring blank are chamfered to prevent cracking caused by stress concentration on edges and too rapid cooling during forging.

(3) Before forging, the niobium-tungsten alloy is sprayed the coating, sheathed the stainless-steel sheath and subjected to soft sheathing with the aluminosilicate fiber, such that an oxidation of the tertiary blank during heating and forging is decreased, a rate of temperature reduction of a surface of the tertiary blank is decreased, and the surface is prevented from cracking caused by stress concentration on edges and too rapid cooling during forging.

(4) Before the core shaft forming, the ring blank is subjected to fluorescent penetrant inspection/dye penetrant inspection to further determine whether there are cracks. The primary pancake is subjected to vacuum stress-relief annealing to eliminate stress during upsetting. A principle of the upsetting during forming the forged ring and a note of the core shaft forging are provided, so as to avoid a lack of height of the primary blank, and a product scrapping caused by flatting the end surface of the ring blank untimely during core shaft forming.

(5) This disclosure machines the inner hole for core shaft forging through WEDM, such that a residue can still be used for processing other parts, which improves the material utilization.

(6) Different from the traditional forging rod or disk, the disclosure employs a core shaft for hole-expansion, which enhances the total forging deformation and facilitates improving the material performance. The forged ring machined by the method provided herein can satisfy the processing requirements of the body of a niobium-tungsten alloy thrust chamber with a diameter of larger than 350 mm and a height of greater than 150 mm.

Described above are merely preferred embodiments of the disclosure, which are not intended to limit the disclosure. It should be understood that replacements, modifications and variations made by those skilled in the art without departing from the spirit and scope of the disclosure shall fall within the scope of the disclosure defined by the appended claims.

What is claimed is:

1. A method for forging a niobium-tungsten alloy forged ring, comprising:

(S1) subjecting a niobium-tungsten alloy ingot to blanking, turning and chamfering to obtain a primary blank; spraying an anti-oxidation coating on a surface of the primary blank to obtain a secondary blank; sheathing the secondary blank with a stainless-steel sheath followed by heating to obtain a tertiary blank; and subjecting the tertiary blank to upsetting to obtain a primary pancake by using a flat die hammer, rapid forging press or hydraulic press;

(S2) machining the primary pancake to remove the stainless-steel sheath and an oxide scale and defect on a surface of the primary pancake; subjecting the surface of the primary pancake to fluorescent penetrant inspection/dye penetrant inspection; when the surface of the primary pancake is free of defects, subjecting the primary pancake to vacuum stress-relief annealing to obtain a secondary pancake; and subjecting the secondary pancake to wire electrical discharge machining (WEDM) to form an inner hole to obtain a ring blank;

(S3) subjecting the ring blank to core shaft/saddle forging on the flat die hammer or rapid forging press to obtain a crude forged ring; and (S4) subjecting the crude forged ring to vacuum recrystallization annealing to obtain a desired forged ring.

2. The method of claim 1, wherein in step (S1), after blanked, the niobium-tungsten alloy ingot is sequentially subjected to turning and chamfering at two end surfaces to obtain the primary blank; the stainless-steel sheath is manufactured from a stainless-steel plate; and the stainless-steel sheath is welded at an outer circumference and an end surface of the secondary blank by an argon arc welding technology.

3. The method of claim 1, wherein in step (S1), the heating is performed through steps of:

loading the secondary blank in a furnace at a temperature not higher than 850° C. followed by preheating at 850-950° C. for 1 h and heating to 1290±40° C.;

subjecting the secondary blank to heating at 1290±40° C. at a heating coefficient of 0.8 mm/min to obtain the tertiary blank; and subjecting the tertiary blank to air cooling;

wherein a final forging temperature is not less than 1000° C.

4. The method of claim 3, wherein when it is required to perform multiple heating operations to form the tertiary blank, the secondary blank is returned to the furnace with a temperature of higher than 800° C. and subjected to heating at a heating coefficient of 0.5 mm/min.

5. The method of claim 1, wherein in step (S1), during the heating process, after heated for a preset period of time, the secondary blank is removed, subjected to soft sheathing with an aluminosilicate fiber with a thickness of 5-12 mm and a binding agent, then returned to the furnace and subjected to heating for 60-120 min to form the tertiary blank.

6. The method of claim 1, wherein in step (S1), a single-fire upsetting deformation of the niobium-tungsten alloy ingot is 0.1-0.35; and a height of the primary pancake obtained after the upsetting is 105-120% of a height of the desired forged ring.

7. The method of claim 1, wherein the step (S2) further comprises:

subjecting inner and outer circular end faces of the ring blank to rounding.

8. The method of claim 7, wherein the step (S2) further comprises:

polishing a surface of the ring blank to eliminate cracks, folds and pits thereon; and subjecting the ring blank after being polished to fluorescent penetrant inspection/dye penetrant inspection to further determine whether there are cracks, folds and pits on the surface of the ring blank;

wherein a width-depth ratio of a polished part on the ring blank is not less than 6:1.

9. The method of claim 1, wherein in step (S2), the vacuum stress-relief annealing is performed at 1250-1350° C. for at least 60 min.

10. The method of claim 1, wherein the step (S3) further comprises:

loading the ring blank at a temperature not higher than 850° C. followed by preheating at 850-950° C. for 1 h and heating to 1290±40° C.;

subjecting the ring blank to heating at 1290±40° C. with a heating coefficient of 0.8 mm/min; and subjecting the ring blank to air cooling;

wherein a final forging temperature is not less than 1000° C.;

after heated for a preset period of time, the ring blank is removed, subjected to soft sheathing with an aluminosilicate fiber with a thickness of 5-12 mm and a binding agent, returned to the furnace and then subjected to heating for 60-120 min.

11. The method of claim 1, wherein in step (S3), a core shaft is placed into the inner hole of the ring blank processed through WEDM; and the inner hole of the ring blank is subjected to expansion on a saddle.

12. The method of claim 1, wherein in step (S4), the vacuum recrystallization annealing is performed at 1350-1450° C. for at least 60 min.

* * * * *